US006534253B1

(12) United States Patent
Kuykendall et al.

(10) Patent No.: US 6,534,253 B1
(45) Date of Patent: Mar. 18, 2003

(54) DIRECT PHOTOGRAPHIC BLEACH-FIXING REPLENISHMENT USING FERROUS BLEACH-FIXING PRECURSOR COMPOSITION

(75) Inventors: Valerie L. Kuykendall, Penfield, NY (US); Sheridan E. Vincent, Rochester, NY (US); Daniel R. English, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/002,820

(22) Filed: Nov. 15, 2001

(51) Int. Cl.[7] ..... G03C 7/42; G03C 7/44
(52) U.S. Cl. ..... 430/393; 430/400
(58) Field of Search ..... 430/393, 400

(56) References Cited

U.S. PATENT DOCUMENTS 4,033,771 A 7/1977 Borton e tal. ..... 430/400
5,055,382 A 10/1991 Long et al. ..... 430/400
5,147,765 A * 9/1992 Goto et al. ..... 430/376

FOREIGN PATENT DOCUMENTS

DE 100 13614 A1 10/2001

OTHER PUBLICATIONS

USSN 09/723,794 (D–80686) titled *Ferrous Photographic Bleach–Fixing Compositions and Methods for Their Use* by S.E. Vincent et al.

* cited by examiner

*Primary Examiner*—Hoa Van Le
(74) *Attorney, Agent, or Firm*—J. Lanny Tucker

(57) ABSTRACT

Photographic bleach-fixing solutions in a processing chamber can be directly replenished using a single-part photographic bleach-fixing "precursor" composition that comprises one or more iron-ligand complexes, one or more thiosulfates as the sole fixing agents, and optionally, a sulfite preservative. At least 50 mol % of the iron in the composition is in the form of Fe(II). Immediately prior to or during directly supplying the precursor composition to the processing chamber from an enclosed container, sufficient ferrous ions are converted to ferric ions to provide desired bleaching in the processing chamber.

21 Claims, No Drawings

DIRECT PHOTOGRAPHIC BLEACH-FIXING REPLENISHMENT USING FERROUS BLEACH-FIXING PRECURSOR COMPOSITION

FIELD OF THE INVENTION

The present invention relates to a method of using a single-part photographic bleach-fixing precursor composition for direct replenishment of a photographic bleach-fixing solution in the processing of photographic silver halide materials. In particular, this invention relates to the use of a single-part bleach-fixing precursor composition comprising predominantly ferrous-ligand complexes.

BACKGROUND OF THE INVENTION

The basic process for obtaining color images from exposed color photographic silver halide materials includes several steps of photochemical processing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have had considerable commercial success in the photographic industry.

To obtain useful color images, it is usually necessary to remove all of the silver from the photographic element after color development. This is sometimes known as "desilvering". Removal of silver is generally accomplished by oxidizing the metallic silver in what is known as a "bleaching" step using a bleaching agent, and then dissolving the oxidized silver and undeveloped silver halide with a silver "solvent" or fixing agent in what is known as a "fixing" step.

It has become common for the processing of certain photographic elements, notably color photographic papers, to combine the bleaching and fixing operations into a single "bleach-fixing" operation that can be carried out in one or more processing steps. Bleach-fixing is usually carried out using a composition that includes both a photographic bleaching agent and a photographic fixing agent, as described for example in U.S. Pat. No. 4,033,771 (Borton et al.).

The most common bleaching agents for color photographic processing are complexes of ferric [Fe(III)] ion and various organic chelating ligands (such as aminopolycarboxylic acids), of which there are hundreds of possibilities, all with varying photographic bleaching abilities and biodegradability. Common organic chelating ligands used as part of bleaching agents for photographic color film processing include ethylenediaminetetraacetic acid (EDTA), 1,3-propylenediaminetetraacetic acid (PDTA) and nitrilotriacetic acid (NTA).

Also known are bleaching, bleach-fixing compositions, and processing methods that utilize a ferric complex of one or more of several alkyliminodiacetic acids (such as methyliminodiacetic acid or MIDA) that are known to be more biodegradable than other common organic chelating ligands such as EDTA. Other photographic bleaching agents using similar organic chelating ligands are described in U.S. Pat. No. 5,061,608 (Foster et al.) in which the ferric bleaching agent is advantageously combined with specific aliphatic carboxylic acids to reduce dye stains.

Typical photographic fixing agents include thiosulfates, sulfites, thiocyanates, and mixtures thereof that readily solubilize or "dissolve" silver ion in the processed photographic materials, as described for example in U.S. Pat. No. 5,633,124 (Schmittou et al.).

As pointed out in U.S. Pat. No. 5,055,382 (Long et al.), when photographic materials are processed in bleach-fixing steps, the bleach-fixing composition is generally formulated from two or more "parts", each "part" or solution typically containing one or more (but not all) of the photochemicals necessary for the processing reactions. For example, one of the "parts" usually contains the conventional ferric bleaching agent, and another of the "parts" usually contains a thiosulfate fixing agent(s) and a sulfite preservative. These "parts" are sometimes provided together in a photochemical processing "kit". If all of the chemicals are formulated in a single concentrate solution, storage stability is reduced or nonexistent since unwanted chemical interactions among components are inevitable. For example, ferric bleaching agents, sulfite preservatives, and thiosulfate fixing agents are inherently reactive, thereby degrading solution effectiveness and storage stability. Thus, most common bleach-fixing solutions are provided from "two parts", each part containing at least one essential reactive component.

Throughout the photographic industry, there is a desire to provide "concentrated" photoprocessing chemicals to reduce handling, transportation and storage costs. A number of successes have been achieved, for example by Eastman Kodak Company, to provide concentrated color developing compositions. The effort directed to providing concentrated bleach-fixing compositions, and especially in a single-part format, has encountered numerous hurdles.

However, successful bleach-fixing has been achieved using a single-part concentrated solution containing the precursor ferrous form of the bleaching agent, as described in copending and commonly assigned U.S. Ser. No. 09/723,794 (filed Nov. 28, 2000 by Vincent et al.).

This unique ferrous-ligand composition, however, is most useful in standard Process RA-4 (Color Paper) or Process C-41 (Color Negative Film) processing methods and equipment because there is sufficient aerial oxidation possible due to adequate contact of the composition with air in the replenishing and processing tanks. Thus, sufficient ferrous ion is oxidized to ferric ion in transit to or while in the bleach-fixing tank to provide adequate photographic bleaching.

Other processing methods and machines used in the industry are commonly known as "minilabs" that utilize "low volume thin tank" (LVTT) processing machines. Processing solutions are typically directly supplied to LVTT machines as "replenisher" solutions from enclosed containers (for example, those known as CUBITAINE® containers available from Hedwin Corporation). Some of these types of containers may be collapsible as described for example in U.S. Pat. No. 5,577,614 (Palmeroni, Jr. et al.). Since several processing solutions (and usually multiple parts to make solutions) are supplied to the LVTT machines directly from individual enclosed containers, the difficulty is that the various solutions may not be used at the same rate and residual solution may be left in some containers, creating disposal problems. In addition, multiple solution supply requires multiple pumping systems that increase the cost of processing and likely error in the amount of solution delivered.

It would be highly desirable to deliver fewer solutions, especially a single-part bleach-fixing solution, to LVTT processing machines. Yet, as pointed out above, conventional bleach-fixing solutions contain reactive components that are incompatible for long term storage. Since the unique ferrous bleach-fixing precursor solution described and claimed in U.S. Ser. No. 09/723,794 (noted above) was invented, opportunities have been sought for using it in various processing systems besides the more conventional "open tank" Process RA-4 systems. The desire was to use the ferrous bleach-fixing precursor solution in LVTT processing systems.

However, we encountered a new problem. The problem arises in that the enclosed containers used to supply processing solutions to LVTT machines and the inherent limited process surface area of LVTT machines provides insufficient air to facilitate the required oxidation of ferrous ion to ferric ion for successful bleaching. In addition, merely providing a high agitation of the ferrous solution would not accomplish the desired purpose because excessive aeration may cause sulfurization to occur.

There is a need in the industry to provide a single-part "bleach-fixing" direct replenisher solution to LVTT processing machines. It would be desirable to use the previously invented ferrous bleach-fixing precursor composition in this manner but the inherent design of LVTT processing machines and supply containers does not readily allow it to be used in this fashion. It is to this need in the photographic industry that the present invention is directed.

SUMMARY OF THE INVENTION

The problems described above have been overcome with a method of processing a color developed, color photographic silver halide material in a processing chamber, the method comprising delivering a single-part bleach-fixing precursor composition to the processing chamber containing the color developed color photographic silver halide material, the bleach-fixing precursor composition being delivered directly from an enclosed container, having a pH of from about 4 to about 10, and comprising:

at least 0.05 mol/l of one or more iron-ligand complexes, at least 0.15 mol/l of one or more thiosulfates as the sole photographic fixing agents, and optionally, one or more sulfites, provided that at least 50 mol % of the iron present in the bleach-fixing precursor composition is in the form of Fe(II), and the bleach-fixing precursor composition being delivered directly to the processing chamber at a rate of at least 5.4 ml/m$^2$ and ferrous ion being converted to ferric ion in the bleach-fixing precursor composition during or after delivery to the processing chamber at a rate of at least 0.0002 mol/m$^2$.

Further, this invention provides a method of providing a color photographic image comprising:

A) color developing an imagewise exposed color photographic silver halide material, B) contacting the color developed color photographic silver halide material with a bleach-fixing solution in a processing chamber for sufficient time to remove at least 95% of the silver in the color developed color photographic silver halide material, and C) replenishing the bleach-fixing solution by delivering a single-part bleach-fixing precursor composition to the processing chamber containing the color developed color photographic silver halide material, the bleach-fixing precursor composition being delivered directly from an enclosed container, having a pH of from about 4 to about 10, and comprising:

at least 0.05 mol/l of one or more iron-ligand complexes, at least 0.15 mol/l of one or more thiosulfates as the sole photographic fixing agents, and optionally, one or more sulfites, provided that at least 50 mol % of the iron present in the bleach-fixing precursor composition is in the form of Fe(II), and the bleach-fixing precursor composition being delivered to the processing chamber at a rate of at least 5.4 ml/m$^2$ and ferrous ion being converted to ferric ion in the bleach-fixing precursor composition during or after delivery to the processing chamber at a rate of at least 0.0002 mol/m$^2$.

The present invention provides a advance in the photoprocessing art for improved use of LVTT type processing systems by using a single-part bleach-fixing precursor composition supplied directly from an enclosed container. This bleach-fixing precursor composition is stable for long-term storage, is in a single-part format, and can be provided and used in concentrated or diluted form. Unwanted chemical interactions are critically minimized for these advantages to be achieved.

As pointed out in copending U.S. Ser. No. 09/723,794, these benefits are obtained by using predominantly ferrous [Fe(II)] compounds in the bleach-fixing precursor composition. By "predominantly" is meant that more than 50 mol % of all iron in the composition is in the form of Fe(II). Preferably, at least 65 mol % of all iron in the composition is in the form of Fe(II), and more preferably from about 70 to 100 mol % of all iron in the composition is in the form of Fe(II).

By "bleach-fixing precursor composition" is meant that the composition used in the practice of this invention is not generally a useful bleach-fixing composition itself, but upon oxidation of sufficient amounts of the Fe(II) ions to Fe(III) ions, the composition can then converted into a useful bleach-fixing composition. Thus, a bleach-fixing composition can be "generated" from the bleach-fixing precursor composition of this invention with appropriate oxidation of the ferrous ions. The precursor composition is stable since the Fe(II) compounds and other active photochemicals therein do not adversely interact.

It is essential, however, that as the bleach-fixing precursor composition is directly delivered to the processing chamber from the enclosed container at a certain rate. In addition, the ferrous ions in the precursor composition are converted to ferric ions during delivery or immediately thereafter at a specific rate that insures that the solution in the processing chamber has sufficient bleaching activity. This provides some control as to the amount of bleach-fixing composition that is available for processing and the time needed for bleach-fixing.

DETAILED DESCRIPTION OF THE INVENTION

Photographic bleach-fixing is carried out in one or more steps using one or more photographic bleaching agents that are Fe(III) complexes of one or more aminopolycarboxylic acid or polyaminopolycarboxylic acid chelating ligands. At least one of those steps is carried out using a bleach-fixing composition that is directly replenished by the single-part bleach-fixing precursor composition described herein. That bleach-fixing precursor composition comprises essential Fe(II)-ligand "precursor" complexes.

In the following discussion, iron-ligand complexed compounds will be referred to as "iron complexes" with the understanding that in the bleach-fixing precursor compositions, they are present predominantly as Fe(II) complexes but in bleach-fixing compositions derived therefrom, they are present predominantly as Fe(III) complexes.

Useful iron complexes comprise one or more polycarboxylic acid chelating ligands. Particularly useful chelating ligands include conventional polyaminopolycarboxylic acids including ethylenediaminetetraacetic acid and others described in *Research Disclosure*, publication 38957, pages 592–639 (September 1996), U.S. Pat. No. 5,582,958 (Buchanan et al.), and U.S. Pat. No. 5,753,423 (Buongiome et al.). *Research Disclosure* is a publication of Kenneth Mason Publications Ltd., Dudley House, 12 North Street, Emsworth, Hampshire PO10 7DQ England. This reference will be referred to hereinafter as "*Research Disclosure*." There are hundreds of possible chelating ligands that are known in the art, the most common ones being ethylenediaminetetraacetic acid (EDTA), 1,3-propylenediaminetetraacetic acid (PDTA), diethylenetriaminepentaacetic acid (DTPA), cyclohexanediaminetetraacetic acid (CDTA) and hydroxyethyl-ethylenediarninetriacetic acid (HEDTA).

Biodegradable chelating ligands are particularly desirable in order to minimize the impact on the environment from discharged photoprocessing solutions.

One particularly useful biodegradable chelating ligand is ethylenediaminedisuccinic acid (EDDS) as described in U.S. Pat. No. 5,679,501 (Seki et al.) and EP-0 532,001B (Kuse et al.). All isomers of EDDS are useful, including the [S,S] isomer, and the isomers can be used singly or in mixtures. The [S,S] isomer is most preferred in the iron-EDDS complexes. Other useful disuccinic acid chelating ligands are described in U.S. Pat. No. 5,691,120 (Wilson et al.).

Aminomonosuccinic acids (or salts thereof) are chelating ligands having at least one nitrogen atom to which a succinic acid (or salt) group is attached. These chelating ligands are also useful in iron complexes. U.S. Pat. No. 5,652,085 (Stickland et al.) provides more details about such chelating ligands, particularly the polyamino monosuccinic acids. Ethylenediamine monosuccinic acid (EDMS) is preferred in this class of chelating ligands.

Other classes of biodegradable aminopolycarboxylic acid or polyaminopolycarboxylic acid chelating ligands that can be used to form biodegradable iron complexes include iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl and t-butyl) as described in EP-A-0 532,003 (Kuse et al.). Particularly useful alkyliminodiacetic acids are methyliminodiacetic acid (MIDA) and ethyliminodiacetic acid (EIDA), and MIDA is the most preferred.

All chelating ligands useful in this invention can be provided as the free acid form or as alkali metal (for example, sodium and potassium) or ammonium salts, or as mixtures thereof.

Still other biodegradable chelating ligands can be represented by the following Structure I:

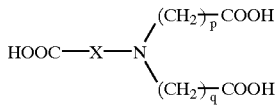

I wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

The iron complexes useful in this invention can be binary complexes (meaning iron is complexed to one or more molecules of a single chelating ligand) or ternary complexes in which iron is complexed to molecules of two distinct chelating ligands similar to iron complexes described for example in U.S. Pat. No. 5,670,305 (Gordon et al.) and U.S. Pat. No. 5,582,958 (noted above). A mixture of multiple binary or ternary iron complexes also can be present in the compositions.

Still other useful biodegradable iron chelating ligands include but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid, and tartaric acid.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

Generally, the one or more iron complexes are present in the bleach-fixing precursor compositions in an amount of at least 0.05 mol/l, up to 3 mol/l, and preferably in an amount of from about 0.15 to about 0.75 mol/l.

The ferrous salts used to provide bleaching agent precursor compounds in the practice of this invention are generally ferrous ion salts that provide a suitable amount of ferrous ion for complexation with the chelating ligands defined above. Useful ferrous salts include, but are not limited to, ferrous ammonium sulfate, ferrous sodium sulfate, ferrous chloride, ferrous bromide, ferrous sulfate, ferrous acetate, ferrous oxalate, ferrous gluconate, and iron oxide. Ferrous sulfate is a preferred ferrous salt. These salts can be provided in any suitable form, including various hydrated forms where they exist, and are available from a number of commercial sources. The heptahydrate form of ferrous sulfate is another preferred source of ferrous ions.

The bleaching agent precursor compounds are generally provided by mixing one or more ferrous ion salts (as described above) with the desired chelating ligands in an aqueous solution. The pH of the solution is adjusted using appropriate acids or bases.

It is not necessary that the ferrous ion and the chelating ligand(s) be present in the bleach-fixing precursor compositions in stoichiometric proportions. It is preferred, however, that the molar ratio of the total chelating ligands to ferrous ion be from about 1:1 to about 5:1. In a more preferred embodiment, the ratio is about 1:1 to about 2.5:1 moles of total chelating ligands per mole of ferrous ion.

Generally speaking, ferrous ions are present in the bleach-fixing precursor compositions in an amount of at least 0.05 mol/l, and preferably in an amount of at least 0.15 mol/l.

As noted above, more than 50 mol % of the iron present in the bleach-fixing precursor compositions is in the Fe(II) form. Thus, up to and almost half of the iron may be present in the Fe(III) form. However, it is preferred that the amount of ferric ion be limited since there may be some natural oxidation of ferrous ion to ferric ion during manufacture and storage of the compositions. As the amount of mol % of Fe(II) is increased compared to Fe(III), the bleach-fixing precursor compositions have increased storage stability.

Chloride, bromide or iodide ions, or mixtures of halides are optionally present in the bleach-fixing precursor compositions. Such ions are provided in the form of water-soluble salts including ammonium, alkali metal and alkaline earth metal salts. The preferred salts are sodium, potassium and ammonium salts.

It is desired that ammonium ions are the predominant ions in the bleach-fixing precursor compositions. That is, ammonium ions comprise at least 50 mol % of the total cations in the compositions.

Buffers are also preferably present in the bleach-fixing precursor compositions in an amount of at least 0.05 mol/l and generally up to 5 mol/l. Useful buffers include but are not limited to, acetic acid, propionic acid, succinic acid, glycolic acid, benzoic acid, maleic acid, malonic acid, tartaric acid, and other water-soluble aliphatic or aromatic carboxylic acids known in the art. Acetic acid and succinic acid are preferred. Succinic acid is more preferred for odor control. Even more preferred buffers are the odorless acids such as succinic acid so the bleach-fixing precursor composition is as odorless as possible. Inorganic buffers, such as borates, hydrobromic acid, sulfites, and carbonates can be used if desired. A mixture of buffers can be used if desired. The bleach-fixing precursor compositions are preferably aqueous solutions having a pH of from about 4 to about 10. A preferred pH is in the range of from about 4.5 to about 8.

Preferably, the single-part bleach-fixing precursor compositions are substantially single-phase and homogeneous, that is they have minimal if no solid material and have a uniform consistency and composition throughout.

The single-part bleach-fixing precursor compositions include one or more thiosulfate-fixing agents as essential components. The fixing agents can be present as thiosulfate salts (that is alkali metal or ammonium salts) as is well known in the art. Fixing accelerators can also be present and include but are not limited to, thioethers, thiocyanates, thiadiazoles, and mercaptotriazoles.

A third essential component of the bleach-fixing precursor compositions is one or more inorganic sulfites or bisulfites that provide sulfite ions. Such compounds include but are not limited to sodium sulfite, potassium sulfite, sodium bisulfite, sodium metabisulfite, ammonium sulfite, and ammonium bisulfite. Sodium metabisulfite and ammonium bisulfite are preferred. The sulfite can act as a preservative for the thiosulfate-fixing agents.

The bleach-fixing precursor compositions can also include other addenda that are commonly used in either working strength or concentrated bleach-fixing solutions, replenishers or regenerators including but not limited to, optical brighteners, whitening agents, organic or inorganic preservatives or antioxidants (such as hydroxylamines and sulfinic acids), water-soluble or -dispersible solvents (such as alcohols and glycols), metal sequestering agents, anti-scumming agents, biocides, anti-fungal agents, and anti-foaming agents.

The following TABLE I shows the general and preferred amounts of the two essential and one optional (but preferred) components of the single-part bleach-fixing precursor compositions useful in this invention. The preferred ranges are listed in parentheses ( ), and all of the ranges are considered to be approximate or "about" in the upper and lower end points. During bleach-fixing, the actual concentrations can vary depending upon extracted chemicals in the composition, replenishment rates, and water losses due to evaporation. Optional components of the compositions may be present in amounts well known by those skilled in the photoprocessing art.

TABLE I

| COMPONENT | CONCENTRATIONS |
|---|---|
| Iron complex(es) | 0.05–3 mol/l<br>(0.15–0.75 mol/l) |
| Thiosulfate fixing agent(s) | 0.15–5 mol/l<br>(0.75–3 mol/l) |
| Sulfite Ion | 0–5 mol/l<br>(0.05–2 mol/l) |

The bleach-fixing precursor compositions can be formulated in working strength or concentrated form (preferably as a concentrate) by mixing one or more iron salts, one or more thiosulfate fixing agents, and one or more sulfites in an appropriate amount of water. Alternatively, the iron complexes can be formed in-situ in a fixing composition by mixing the iron salts with the chelating ligands within the fixing composition.

Fe(II)-ligand complexes are not active photographic bleaching agents. Thus, when the bleach-fixing precursor compositions of this invention are used, the ferrous ions must be oxidized in some manner to provide active ferric ions. Since the bleach-fixing precursor compositions are provided from an enclosed container that contains limited oxygen, ferrous ion oxidation must occur during or after direct delivery of the composition to the processing chamber.

For example, during direct delivery from the enclosed container (for example, in delivery lines), ferrous ion oxidation can be carried out by bubbling air or oxygen through the bleach-fix precursor solution in the delivery line or in a chamber prior to or during delivery to the processing chamber.

Preferably, oxidation is carried out by treating the solution with air or oxygen consisting of small bubbles produced, for example, by a sparger (a device that produces small air bubbles) such that the surface area of the bubbles contacting the solution is increased.

Alternatively, after the bleach-fixing precursor composition is directly delivered to the processing chamber and mixed with bleach-fixing composition therein, ferrous ions can be oxidized immediately for use by bubbling air through the bleach-fixing composition. Preferably, oxidation is carried out in this situation by bubbling air or oxygen through a sparger located in the processing chamber.

The rate of conversion of ferrous ions to ferric ions is at least 0.0002 mol/$m^2$ and preferably from about 0.002 to about 0.02 mol/$m^2$. As one skilled in the art would appreciate, the rate of ferrous ion oxidation will be dependent upon the amount of silver present in the photographic elements being processed. For example, during the processing of color photographic papers that generally have relatively lower silver coverage, the rate of oxidation required would generally be lower.

The rate of replenishment used in the practice of this invention is to directly supply at least 5 ml/$m^2$ of the bleach-fixing precursor composition to the processing chamber. Preferably, the rate of replenishment is from about 10 to about 110 ml/$m^2$.

By "direct" delivery in the practice of this invention, we mean that the bleach-fixing precursor composition is supplied to the processing chamber from the enclosed container without any passage into or through another processing vessel or tank, or chemical treatment. The delivered composition may be diluted "in-line", or aerated as described above.

Preferred embodiments of this invention comprise the direct delivery to the processing chamber (under the conditions described above) of a single-part bleach-fixing precursor composition having a pH of from about 4.5 to about 8 and comprising:

from about 0.15 to about 0.75 mol/l of one or more iron-ligand complexes, the iron-ligand complexes comprising a ligand selected from the group consisting of ethylenediaminetetraacetic acid, 1,3-propylenediaminetetraacetic acid, ethylenediamine disuccinic acid, methyliminodiacetic acid, alaninediacetic acid, nitrilotriacetic acid, ethylenediamine monosuccinic acid, 2,6-pyridinedicarboxylic acid, and salts thereof, from about 0.75 to about 3 mol/l of ammonium thiosulfate, potassium thiosulfate, or sodium thiosulfate (or mixtures thereof) as the sole photographic fixing agent, and from about 0.05 to about 2 mol/l of one or more sulfites as the sole preservatives for the thiosulfate, from about 0.1 to about 1 mol/l of acetic acid, succinic acid, glycolic acid, maleic acid, propionic acid, malic acid, benzoic acid, or a mixture of two or more of these acids as buffers, provided from about 70 to 100 mol % of the iron present in the bleach-fixing precursor composition is in the form of Fe(II).

Color developing compositions are generally used prior to "desilvering" using the bleach-fixing precursor compositions described herein. Color developing compositions generally include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as described in U.S. Pat. No. 4,876,174 (Ishikawa et al.), U.S. Pat. No. 5,354,646 (Kobayashi et al.), U.S. Pat. No. 4,892,804 (Vincent et al.), and U.S. Pat. No. 5,660,974 (Marrese et al.), EP 0 434 097A1 (published Jun. 26, 1991), and EP 0 530 921A1 (published Mar. 10, 1993). It may be useful for the color developing agents to have one or more water-solubilizing groups as are known in the art. Further details of such materials are provided in *Research Disclosure*, noted above.

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in U.S. Pat. No. 6,077,653 (McGarry et al.). Mixtures of compounds from the same or different classes of antioxidants can also be used if desired.

Especially useful antioxidants are hydroxylamine derivatives as described for example, in U.S. Pat. Nos. 4,892,804, 4,876,174, 5,354,646, and 5,660,974, all noted above, and U.S. Pat. No. 5,646,327 (Bums et al.), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.). Specific di-substituted hydroxylamine antioxidants include, but are not limited to: N,N-bis(2,3-dihydroxypropyl) hydroxylamine, N,N-bis(2-methyl-2,3-dihydroxypropyl) hydroxylamine and N,N-bis(1-hydroxymethyl-2-hydroxy-3-phenylpropyl)hydroxylamine. The first compound is preferred.

Buffering agents are generally present in the color developing compositions to provide or maintain desired alkaline pH of from about 7 to about 13, and preferably from about 8 to about 12. These buffering agents must be soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

The color developing compositions can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with or without lithium, magnesium or other small cations), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The amounts of such additives are well known in the art also.

Bleach-fixing compositions generated from the bleach-fixing precursor compositions described herein have utility to desilver any imagewise exposed, color developed color photographic silver halide element comprising a support and one or more silver halide emulsion layers. A wide variety of types of photographic elements (both color negative and color reversal films and papers, and color motion picture films and prints) containing various types of emulsions can be processed using the present invention, the types of elements being well known in the art (see *Research Disclosure*, noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure*, noted above. Included within such teachings in the art is the use of various classes of cyan, yellow and magenta color couplers that can be used with the present invention (including pyrazolone and pyrazolotriazole type magenta dye forming couplers.

Examples of commercial color reversal films that can be processed using the present invention include, but are not limited to, EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Examples of commercial color negative films that can be processed using the present invention include, but are not limited to KODAK ROYAL GOLD Color Films (especially the 1000 speed color film), KODAK GOLD MAX Color Films, KODAK ADVANTIX Color Films, KODAK VERICOLOR III Color Films, KONICA VX400 Color Film, KONICA Super SR400 Color Film, FUJI SUPER Color Films, and LUCKY Color Films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.).

Some examples of commercial color papers that can be processed using the present invention include, but are not limited to KODAK EKTACOLOR EDGE 5, 7 and 8 Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), KODAK EKTAMAX Color Paper (Eastman Kodak Company), KODAK PROFESSIONAL Digital III Paper (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II, and PRESTIGE Color Papers (AGFA). The compositions and constructions of such commercial color photographic elements would be readily determined by one skilled in the art.

KODAK DURATRANS, KODAK DURACLEAR, EKTAMAX and KODAK DURAFLEX photographic materials can also be processed using the present invention.

Processing of an imagewise exposed photographic silver halide element is carried out by contacting the element with a color developing composition under suitable time and temperature conditions, in suitable processing equipment, to produce the desired developed image. Additional processing steps can then be carried out using a bleach-fixing composition replenished by the bleach-fixing precursor compositions described herein. Bleach-fixing and additional processing steps can be carried out using conventional times and temperatures. Various rinsing and/or stabilizing and drying steps can also be used as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure*, noted above).

Bleach-fixing compositions replenished by the bleach-fixing precursor compositions described herein can be used prior to or following conventional bleaching and fixing steps, or conventional bleach-fixing steps in which conventional ferric ion-ligand complexes are used for bleaching. For example, the following processing sequences are representative of methods of this invention (but the invention is not considered to be limited thereby) wherein the bleach-fixing composition replenished from the bleach-fixing precursor composition is used in the step identified by * ("washing" can also be "rinsing" or "dye stabilizing"):

(1) Color development→Bleach-fixing*→Washing (2) Color development→Bleaching→Bleach-fixing*→Washing (3) Color development→Bleach-fixing*→Fixing→Washing (4) Color development→Acid stop→Bleaching→Bleach-fixing*→Washing (5) Black-and-white development→Reversal bath→Color development→Prebleaching→Bleach-fixing*→Washing (6) Color development→Fixing→Bleach-fixing*→Washing Processing according to the present invention can be carried out in a processing chamber to which the bleach-fixing precursor composition is delivered from an enclosed container. In most cases, the processing chamber is not a conventional deep tank holding the processing solution. Rather, the processing chamber is usually narrow and has limited volume. Such processing chambers include those known in the art as "low volume thin tank" processing systems, or LVTT processing equipment that has either a rack-and-tank or automatic tray design. Such processing methods and equipment are described, for example, in U.S. Pat. No. 5,436,118 (Carli et al.) and various publications noted therein, all incorporated herein by reference.

The single-part bleach-fixing precursor compositions described herein are usually supplied directly to the processing chamber without dilution, but dilution up to 10 times during delivery can be used if desired.

The processing time and temperature used for each processing step of the present invention are generally those conventionally used in the art. For example, color development is generally carried out at a temperature of from about 20 to about 60° C. The overall color development time can be up to 4 minutes, and preferably from about 25 to about 45 seconds, especially for processing color photographic papers.

Bleach-fixing is generally carried out in less than 8 minutes. For example, the time may be within 5 minutes, more preferably within 2 minutes, and most preferably within 50 seconds. For processing most color photographic papers, bleach-fixing may be as short as 10 seconds. In all processing methods, preferably at least 95% of the silver in the processed material is bleached during this bleach-fixing step. Bleach-fixing temperatures are generally from about 20 to about 45° C.

During the bleach-fixing step, the processing bath may accumulate dissolved silver halide, and other substances that are extracted from the processed photographic element. Such materials, and particularly silver halide, can be removed using known means, such as ion exchange, electrolysis, electrodialysis and precipitation.

The single-part bleach-fixing precursor compositions described herein are usually supplied in suitable enclosed container for use in the processing equipment. Such containers can include, but are not limited to, glass or plastic bottles, vials, drums, or rigid or partially or wholly collapsible plastic containers (such as the containers described in U.S. Pat. No. 5,577,614, noted above).

The following examples are provided to illustrate the practice of this invention and are not meant to be limiting in any manner.

COMPARATIVE EXAMPLE

Samples of various commercial photographic color papers (KODAK EKTACOLOR EDGE 8, KODAK PORTRA III, KODAK ULTRA III, KODAK EKTAMAX, FUJI CRYSTAL ARCHIVE, and KONICA QA7 Color Papers) were processed in a LVTT processing machine (Noritsu 1701) using conventional KODAK EKTACOLOR SM Color Developer and KODAK EKTACOLOR SM Stabilizer & Replenisher as the starting solutions and replenishers. The noted processing equipment was modified to simulate an LVTT processing system.

The bleach-fixing composition was replenished by the following bleach-fixing precursor composition:

| | |
|---|---|
| Ethylenediaminetetraacetic acid | 45.5 g/l |
| Glacial acetic acid | 12 g/l |
| Fe(II) sulfate heptahydrate | 40.75 g/l |
| Sodium metabisulfite | 50 g/l |
| Ammonium thiosulfate | 73.5 g/l |
| Ammonium hydroxide | 70 g/l |
| Ammonium sulfite | 5 g/l |
| Water to make 1 liter | |
| pH of 5. | |

Processing times and conditions used in this processing method are shown in TABLE II below.

TABLE II

| Processing Step | Time (sec.) | Temperature (° C.) | Replenishment Rate (ml/m$^2$) |
|---|---|---|---|
| Color development | 45 | 38 | 162 |
| Bleach-fixing | 45 | 36 | 54 |
| Stabilizing/rinsing | 90 | 36 | 248 |

Each processing solution (including the bleach-fixing precursor composition) was delivered to the processing chamber of the LVTT processor from an individual enclosed container without exposure to air (other than the small amount of ambient air in the container). No aeration of the processing solution was carried out. We determined that insufficient ferrous ions were oxidized to ferric ions in the bleach-fixing precursor composition so bleaching was inadequate. This was seen from the buildup of ferrous ions in the bleach-fixing processing chamber shown in TABLE III below.

TABLE III

| Tank Turnover | Ferrous Ion (g/l) | pH |
|---|---|---|
| 0.5 | 1.76 | 6.28 |
| 1 | 2.08 | 6.30 |
| 1.5 | 2.08 | 6.35 |
| 2.0 | 2.61 | 6.39 |
| 2.5 | 2.72 | 6.32 |

Due to the buildup of ferrous ions in the bleach-fixing solution that results from insufficient contact of the solution with oxygen due to the low surface area of the solution in the LVTT tank, and due to the enclosed containers restricting contact of the replenisher solution to air, bleaching was inadequate as shown by an increase in IR density as shown in the following TABLE IV.

TABLE IV

| | IR DENSITY | | | | | | | |
|---|---|---|---|---|---|---|---|---|
| Color Paper | Start $D_{min}$ | Start $D_{max}$ | 1.0 TTO $D_{min}$ | 1.0 TTO $D_{max}$ | 1.5 TTO $D_{min}$ | 1.5 TTO $D_{max}$ | 2.0 TTO $D_{min}$ | 2.0 TTO $D_{max}$ |
| EDGE 8 | — | — | 0.81 | 1.00 | — | — | 0.83 | 1.16 |
| EDGE 8 | — | — | — | — | 0.82 | 1.12 | — | — |
| EKTAMAX | 0.89 | 0.94 | 0.88 | 1.30 | 0.90 | 1.42 | 0.90 | 1.48 |
| PORTRA III | 0.86 | 0.91 | 0.86 | 1.04 | 0.87 | 1.15 | 0.88 | 1.19 |
| ULTRA III | 0.86 | 0.98 | 0.86 | 1.18 | 0.87 | 1.30 | 0.87 | 1.35 |
| FUJI CRYSTAL Archive | 0.81 | 0.85 | 0.82 | 0.98 | 0.82 | 1.11 | 0.83 | 1.14 |
| KONICA QA7 | 0.83 | 0.85 | 0.83 | 0.86 | 0.87 | 1.01 | 0.84 | 1.08 |
| Digital III | 0.89 | 0.92 | 0.88 | 1.13 | 0.87 | 1.22 | 0.90 | 1.26 |

"TTO" is tank turn-over.

EXAMPLE 1

Processing in LVTT Processor

As noted in the Comparative Example, insufficient conversion of ferrous ions in the bleach-fixing precursor composition to ferric ions was achieved merely by pumping the composition from the enclosed container into the processing tanks. We found that this problem could be overcome in the following manner.

Several samples of some of the same commercial photographic color papers were processed using a conventional Process RA-2SM LVTT Noritsu 1701 processor and the conventional KODAK EKTACOLOR SM Color Developer and KODAK EKTACOLOR SM Stabilizer & Replenisher supplied from individual enclosed containers. Processing of the imagewise exposed color paper samples was carried out using the conventional PROCESS RA-2SM processing conditions. In addition, the bleach-fixing precursor composition described herein was supplied from a third enclosed container, and an aeration pump was installed in the delivery line between that third enclosed container and the processing chamber of the processor. Aeration can be varied with the size of the delivery line and rate of replenishment. Aeration was carried out only as the color paper samples were processed so that excessive oxidation of the solution leading to sulfurization was prevented.

The bleach-fixing precursor composition was supplied as the replenisher solution having the components shown in the following TABLE V.

TABLE V

| Components | Replenisher Amount |
|---|---|
| Ethylenediaminetetraacetic acid | 113.75 g/l |
| Glacial acetic acid | 75 g/l |
| Ferrous sulfate heptahydrate (20%) | 101.88 g/l [20.465 g/l of Fe(II)] |
| Sodium metabisulfite | 50 g/l |
| Ammonium thiosulfate | 226 g/l |
| Ammonium sulfite | 16 g/l |
| pH Adjusted to: (with ammonium hydroxide) | 4.8 |
| Water to final volume of: | 1 Liter |

The processing protocol was as shown in the following TABLE VI:

TABLE VI

| | Time (sec) | Temperature (° C.) | Tank Size (liters) | Replenishment Rate (ml/m$^2$) |
|---|---|---|---|---|
| Color Developer (Part A) | 25 | 40 | 1.8 | 3.02 |
| Color Developer (Part B) | | | | 5.51 |
| Color Developer (Part C) | | | | 5.83 |
| Water | | | | 50.4 |
| Bleach-fixing Precursor Composition | 25 | 35 | 1.8 | 27 |
| Stabilizer | 90 | 35 | 4 at 1 liter each | 1.49 |
| Water | | | | 193 |

Imagewise exposed samples of various imagewise exposed commercial color papers (KODAK EKTACOLOR EDGE 8, KODAK ULTRA III, KODAK EKTAMAX, and KODAK SUPRA III Color Papers). The ferrous ions in the bleach-fixing precursor composition were converted to ferric ions by air oxidation using the installed aeration pump. The results of this aeration in the bleach-fixing solution in the processing tank are shown in the following TABLE VII.

TABLE VII

| Tank Turnovers (TTO) | Ferrous Ion in Tank (g/l) | Change in Ferrous Ion in 1.8 liter Tank with 0.5 TTO Processing | Rate of Ferrous to Ferric Ion Conversion (mol/m$^2$) with 0.5 TTO Processing |
|---|---|---|---|
| 0.5 | 1.23 | — | — |
| 1.0 | 1.73 | −0.90 | 0.0104 |
| 1.5 | 1.33 | −0.72 | 0.0113 |
| 2.0 | 1.81 | 0.86 | 0.0104 |
| 2.5 | 0.98 | −1.49 | 0.0118 |
| 3.0 | 1.34 | 0.65 | 0.0109 |
| 3.5 | 0.97 | −0.67 | 0.0116 |
| 4.0 | 1.36 | 0.70 | 0.0109 |
| | | | Average of 0.0110 |

The results of processing are shown in the following TABLE VIII.

TABLE VIII

| | IR DENSITY | | | | | | | |
|---|---|---|---|---|---|---|---|---|
| | Current Seasoned PROCESS RA-2SM | | Current Fresh PROCESS RA-2SM | | Results With Ferrous Bleach-Fixer Precursor | | | |
| | | | | | 3.0 TTO | 3.0 TTO | 4.0 TTO | 4.0 TTO |
| Color Paper | $D_{min}$ | $D_{max}$ | $D_{min}$ | $D_{max}$ | $D_{min}$ | $D_{max}$ | $D_{min}$ | $D_{max}$ |
| EDGE 8 | 0.81 | 1.11 | 0.80 | 0.87 | 0.81 | 0.84 | 0.81 | 0.85 |
| EKTAMAX | 0.88 | 1.36 | 0.87 | 0.91 | 0.87 | 1.13 | 0.87 | 1.21 |
| ULTRA III | 0.88 | 1.43 | 0.86 | 0.90 | 0.87 | 1.12 | 0.87 | 1.15 |
| SUPRA III | 0.87 | 1.29 | 0.87 | 0.90 | 0.87 | 1.04 | 0.87 | 1.10 |
| EDGE 8 Control | 0.79 | 1.07 | 0.79 | 0.82 | 0.79 | 0.82 | 0.79 | 0.83 |

"TTO" is tank turn-over.

During processing, silver was desirably removed from the KODAK EKTACOLOR EDGE 8, KODAK ULTRA III, KODAK EKTAMAX, and KODAK SUPRA III Color Paper samples using the present invention equivalently to or better than the process carried out using seasoned KODAK EKTACOLOR SM Bleach-Fix & Replenisher. These results also show acceptable sensitometry and a stable solution with sufficient sulfite remaining to prevent sulfurization from occurring.

The mol/m$^2$ rate of ferrous to ferric oxidation was calculated in the following manner:

The change in the tank Fe(II) concentration (ΔFe(II)tank) upon 0.5 TTO (33.5m$^2$ paper processed) is equal to:

$$A+B-C-D,$$

Where:

"A" is the ferrous generated from bleaching of silver, molar equivalent to the silver in the EDGE 8 Color Paper processed and is equal to [(46.5 mg/ft$^2$)(10.7639 ft$^2$/m$^2$)(33.5 m$^2$)(1 g/1000 mg)(55.847 g/mol)]/107.8682 g/mol 8.681 g.

"B" is the ferrous ion concentration measured in the replenisher solution minus that which is converted to ferric on aeration times the replenishment rate (26.9 ml/m$^2$) and is equal to (16.3 g/liter ferrous ion measured in replenisher)(26.9 ml/m$^2$)(1 liter/1000 ml)(33.5 m$^2$)−(g/liter Fe(II) oxidized to $Fe(III)_{0.5\ TTO}$)(26.9 ml/m$^2$)(1 liter/1000 ml)(33.5 m$^2$) that is equal to 14.689 g−(0.901 liter)(g/liter Fe(II) oxidized to $Fe(III)_{0.5\ TTO}$).

"C" is the tank ferrous concentration times the carry out (3 ml/ft$^2$) and is equal to $[Fe(II)_{tank}]$(3 ml/ft$^2$)(10.7639 ft$^2$/m$^2$)(33.5 m)(1liter/1000 ml) that is equal to (1.082 liter)$[Fe(II)_{tank}]$.

"D" is the tank ferrous concentration times the overflow (2.5 ml/ft$^2$) and is equal to $[Fe(II)_{tank}]$(2.5 ml/ft$^2$)(10.7639 ft$^2$/m$^2$)(33.5 m$^2$) (1 liter/1000 ml) that is equal to (0.901 liter)$[Fe(II)_{tank}]$.

Putting together the equation parts:

$$\Delta Fe(II)_{tank}=8.681\text{ g}+14.689\text{ g}-(0.901\text{ liter})(\text{g/liter Fe(II) oxidized to } Fe(III)_{0.5\ TTO})-(1.082\text{ liter})[Fe(II)_{tank}]-(0.901\text{ liter})[Fe(II)_{tank}].$$

$\Delta Fe(II)_{tank}$=23.37 g−(0.901 liter)(g/liter Fe(II) oxidized to $Fe(II)_{0.5\ TTO}$)−(1.983 liters) $[Fe(II)_{tank}]$, or rearranging the terms, (g/liter Fe(II) oxidized to $Fe(II)_{0.5\ TTO}$)=[23.37 g−(1.983 liters)$[Fe(II)_{tank}]$−$\Delta Fe(II)_{tank}$]/(0.901 liter).

In Example (1), from 0.5 to 1.0 TTO:

$\Delta Fe(II)_{tank}$=1.73−1.23 g/liter=0.50g/liter(1.8 liter tank)=0.9 g $[Fe(II)_{tank}]$=[1.23+1.73 g/liter)]/2=average ferrous tank concentration=1.48 g/liter.

Therefore:

(g/liter of Fe(II) oxidized to $Fe(III)_{0.5\ TTO}$)=[23.37 g−(1.983 liters)(1.48 g/liter)−0.9 g]/0.901 liter=21.68 g/liter.

Used 0.901 liter in 0.5 TTO, so [21.68 g/liter (0.901 liter)/(55.847 g/mol)]/(33.5 m$^2$)=0.0104 mol/m$^2$ ferrous ion converted to ferric ions.

The invention has been described in detail with particular reference to certain preferred embodiments thereof, but it will be understood that variations and modifications can be effected within the spirit and scope of the invention.

We claim:

1. A method of processing a color developed, color photographic silver halide material in a processing chamber, said method comprising delivering a single-part bleach-fixing precursor composition to said processing chamber containing said color developed, color photographic silver halide material, said bleach-fixing precursor composition being delivered directly from an enclosed container, having a pH of from about 4 to about 10, and comprising:

at least 0.05 mol/l of one or more iron-ligand complexes, at least 0.15 mol/l of one or more thiosulfates as the sole photographic fixing agents, and optionally, one or more sulfites, provided that at least 50 mol % of the iron present in said precursor composition is in the form of Fe(II), and said bleach-fixing precursor composition being delivered directly to said processing chamber at a rate of at least 5.4 ml/m$^2$ and ferrous ion being converted to ferric ion in said bleach-fixing precursor composition during or after delivery to said processing chamber at a rate of at least 0.0002 mol/m$^2$.

2. The method of claim 1 wherein said bleach-fixing precursor composition has a pH of from about 4.5 to about 8.

3. The method of claim 1 wherein said bleach-fixing precursor composition comprises from about 0.15 to about 0.75 mol/l of one or more iron complexes.

4. The method of claim 1 wherein said bleach-fixing precursor composition comprises at least one iron complex comprising an aminopolycarboxylic acid or polyaminopolycarboxylic acid, or salt thereof.

5. The method of claim 4 wherein said bleach-fixing precursor composition comprises at least one iron complex that comprises a biodegradable aminopolycarboxylic acid or polyaminopolycarboxylic acid, or salt thereof.

6. The method of claim 1 wherein said bleach-fixing precursor composition comprises an iron complex that comprises a ligand selected from the group consisting of ethylenediaminetetraacetic acid, 1,3-propylenediaminetetraacetic acid, ethylenediamine disuccinic acid, methyliminodiacetic acid, alaninediacetic acid, nitrilotriacetic acid, ethylenediamine monosuccinic acid, 2,6-pyridinedicarboxylic acid, and salts thereof.

7. The method of claim 6 wherein said bleach-fixing precursor composition comprises sodium thiosulfate, potassium thiosulfate, ammonium thiosulfate, or mixtures of any of these.

8. The method of claim 1 wherein said sole photographic thiosulfate fixing agent is present in an amount of from about 0.75 to about 3 mol/l, and said bleach-fixing precursor composition comprises from about 0.05 to about 2 mol/l of said sulfite.

9. The method of claim 1 wherein said bleach-fixing precursor composition comprises from about 70 to 100 mol % of the iron present therein in the form of Fe(II).

10. The method of claim 1 wherein said bleach-fixing precursor composition further comprises at least 0.05 mol/l of one or more carboxylic acids as buffer(s).

11. The method of claim 1 wherein said bleach-fixing precursor composition has a pH of from about 4.5 to about 8 and comprises:

from about 0.15 to about 0.75 mol/l of one or more iron-ligand complexes, said iron complexes comprising a ligand selected from the group consisting of ethylenediaminetetraacetic acid, 1,3-propylenediaminetetraacetic acid, ethylenediamine disuccinic acid, methyliminodiacetic acid, alaninediacetic acid, nitrilotriacetic acid, ethylenediamine monosuccinic acid, 2,6-pyridinedicarboxylic acid, and salts thereof, from about 0.75 to about 3 mol/l of potassium thiosulfate, sodium thiosulfate, or ammonium thiosulfate as the sole photographic fixing agent, from about 0.05 to about 2 mol/l of one or more sulfites, and from about 0.1 to about 1 mol/l of acetic acid, succinic acid, glycolic acid, maleic acid, propionic acid, malic acid, benzoic acid, or any mixture of these acids, provided from about 70 to 100 mol % of the iron present in said bleach-fixing precursor composition is in the form of Fe(II).

12. The method of claim 1 wherein said bleach-fixing precursor composition is delivered to said processing chamber at a rate of from about 10 to about 110 ml/m$^2$.

13. The method of claim 1 wherein ferrous ions in said bleach-fixing precursor composition are converted to ferric ion during or after delivery to said processing chamber at a rate of from about 0.002 to about 0.02 mol/m$^2$.

14. The method of claim 1 wherein ferrous ions in said bleach-fixing precursor composition are converted to ferric ions during delivery to said processing chamber by bubbling air or oxygen through the bleach-fix precursor solution in the delivery line or in a chamber prior to or during delivery to the processing chamber.

15. The method of claim 1 wherein ferrous ions in said bleach-fixing precursor composition are converted to ferric ions after delivery to said processing chamber by bubbling air or oxygen through a sparger located in the processing chamber.

16. A method of providing a color photographic image comprising:

A) color developing an imagewise exposed color photographic silver halide material, B) contacting said color developed color photographic silver halide material with a bleach-fixing solution in a processing chamber for sufficient time to remove at least 95% of the silver in said color developed color photographic silver halide material, and C) replenishing said bleach-fixing solution by delivering a single-part bleach-fixing precursor composition to said processing chamber containing said color developed color photographic silver halide material, said bleach-fixing precursor composition being delivered from an enclosed container, having a pH of from about 4 to about 10, and comprising at least 0.05 mol/l of one or more iron-ligand complexes, at least 0.15 mol/l of one or more thiosulfates as the sole photographic fixing agents, and optionally one or more sulfites, provided more than 50 mol % of the iron present in said bleach-fixing precursor composition is in the form of Fe(II), and said bleach-fixing precursor composition being delivered directly to said processing chamber at a rate of at least 5.4 ml/m$^2$ and ferrous ion being converted to ferric ion in said bleach-fixing precursor composition during or after delivery to said processing chamber at a rate of at least 0.0002 mol/m$^2$.

17. The method of claim 16 wherein said photographic silver halide material is a color photographic paper.

18. The method of claim 16 wherein said bleach-fixing precursor composition is delivered directly to said processing chamber at a rate of from about 10 to about 110 ml/m$^2$, and ferrous ions in said bleach-fixing precursor composition are converted to ferric ion during or after delivery to said processing chamber at a rate of from about 0.002 to about 0.02 mol/$m^2$.

19. The method of claim 16 wherein ferrous ions in said bleach-fixing precursor composition are converted to ferric ions during delivery to said processing chamber by bubbling air or oxygen through the bleach-fix precursor solution in the delivery line or in a chamber prior to or during delivery to the processing chamber.

20. The method of claim 16 wherein ferrous ions in said bleach-fixing precursor composition are converted to ferric ions after delivery to said processing chamber by bubbling air or oxygen through a sparger located in the processing chamber.

21. The method of claim 16 wherein step B is carried out within 50 seconds.

* * * * *